United States Patent [19]

Drake

[11] 4,280,699

[45] Jul. 28, 1981

[54] GAME RACQUET

[75] Inventor: Charles A. Drake, San Diego, Calif.

[73] Assignee: Leach Industries, San Diego, Calif.

[21] Appl. No.: 115,780

[22] Filed: Jan. 25, 1980

[51] Int. Cl.[3] ..... A63B 49/12

[52] U.S. Cl. ..... 273/73 C; 273/73 D; 273/73 H

[58] Field of Search ..... 273/73 R, 73 C, 73 D, 273/73 F, 73 G, 73 H

[56] References Cited

U.S. PATENT DOCUMENTS

| | | | |
|---|---|---|---|
| 3,086,777 | 4/1963 | Lacoste | 273/73 H |
| 4,066,260 | 1/1978 | Rodgers | 273/73 C |
| 4,165,071 | 8/1979 | Frolow | 273/73 H X |

FOREIGN PATENT DOCUMENTS

| | | | |
|---|---|---|---|
| 208945 | 1/1957 | Australia | 273/73 R |
| 220103 | 8/1924 | United Kingdom | 273/73 G |
| 381673 | 10/1932 | United Kingdom | 273/73 H |
| 482164 | 3/1938 | United Kingdom | 273/73 H |
| 1207662 | 10/1970 | United Kingdom | 273/73 H |
| 1434741 | 5/1976 | United Kingdom | 273/73 F |

*Primary Examiner*—Richard J. Apley

*Attorney, Agent, or Firm*—LeBlanc, Nolan, Shur & Nies

[57] ABSTRACT

A game racquet having a metal frame member that is of greatest size in the outer head region for increased weight there and which at opposite sides of the head is of stepped successively decreasing size toward the racquet handle, the throat region being relatively flexible as compared to the head regions outwardly thereof.

8 Claims, 3 Drawing Figures

GAME RACQUET

This invention relates to game racquets, principally racquetball racquets, and particularly to stepped frame racquets having desirable built-in weight distribution, head and throat characteristics and balance point location.

Substantially all metal or metal-plastic frame game racquets known to be available today, and nearly all prior art disclosures of such known to applicant, retain substantially the same effective cross sectional size throughout at least the head defining portions of the frame. An exception to this is Robinson U.S. Pat. No. 2,171,233 wherein there is disclosed a metal racquet frame that at opposite sides of the striking head is of changing size increments that increase in size in steps from the opposite ends of the outer end of the head toward the handle. The invention contemplates a racquet structure that is structurally opposite to Robinson's teachings, and involves a different principle of ball control.

The desirability of localized weight control in the head region has been recognized, but known solutions of the problem have embodied the provision of attaching separate weights within or otherwise on the metal frame, as disclosed in Rodgers U.S. Pat. No. 4,066,260. In the invention desired weight distribution is automatically built into the racquet frame incidental to manufacture.

The invention basically concerns a novel game racquet structure wherein a metal frame member is longitudinally shaped to define the striking head outline with opposite ends brought together side by side for incorporation in a handle, characterized by the frame head having a desired larger weight imparting size through its outer region remote from the handle and the opposite sides of the frame head comprising increments of progressively decreasing size between the opposite ends of said outer head portion and the portions incorporated in the handle, and this is the major object of the invention.

A more detailed object of the invention is to provide a novel game racquet having a metal frame member shaped to outline the striking head wherein the frame cross section is of greater size throughout a region extending around the outer end of the head and is of incrementally decreasing size between the opposite ends of that outer end region and the throat, whereby the racquet is of increased weight at the outer end of the head and effectively flexible at the throat.

Further objects of the invention will appear as the description proceeds in connection with the appended claims and the associated drawings.

PREFERRED EMBODIMENTS

Figure 1:
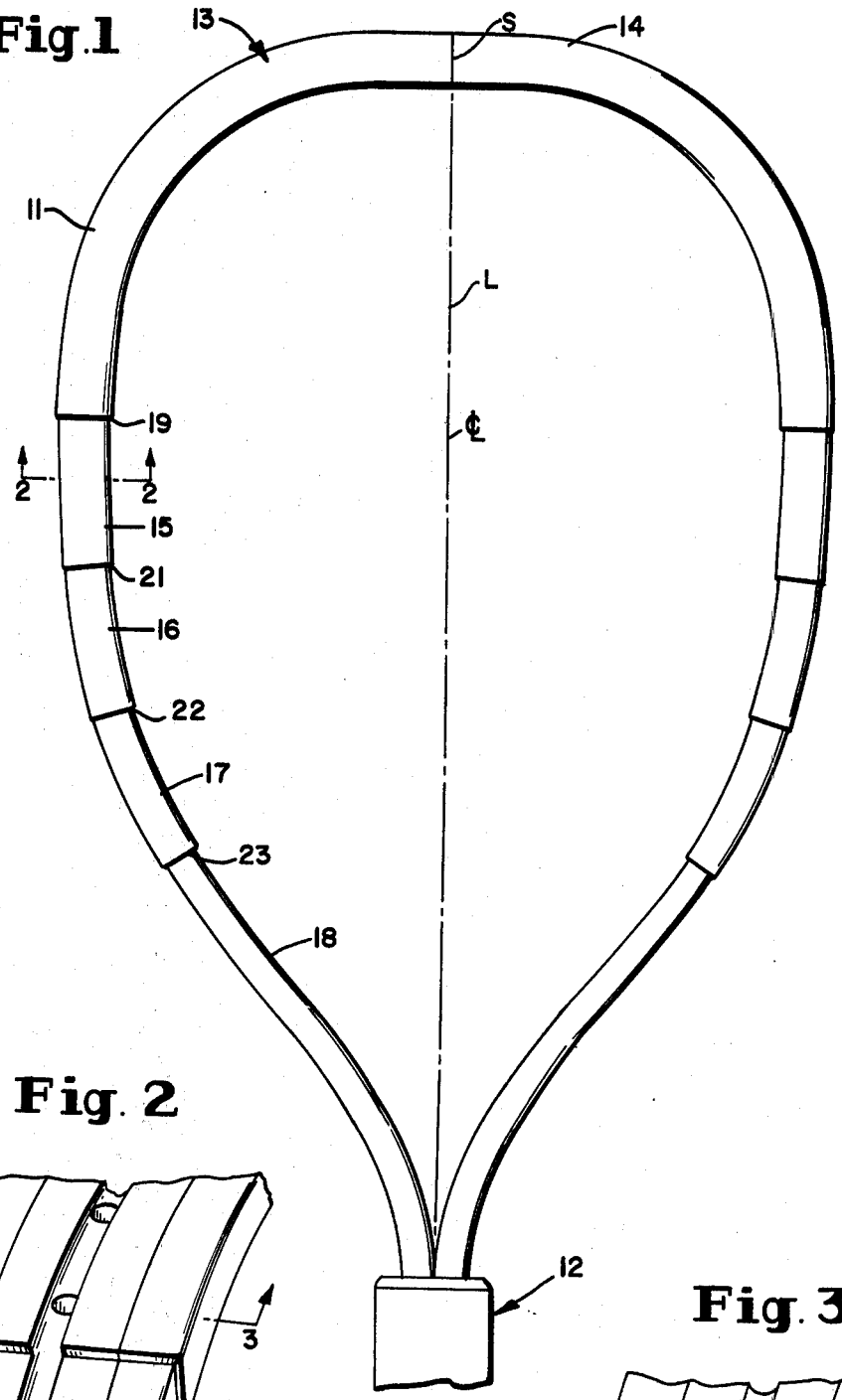
FIG. 1 is a side elevation illustrating a racquet of the invention in a preferred embodiment.

FIG. 1 illustrates the stepped nature of the metal racquet frame according to the invention. As shown the racquet comprises a head 11 and a handle 12.

The illustrated racquet is of the laminated metal-plastic type wherein an extruded or suitably drawn metal frame member 13 assumes the eventual racquet head outline with opposite ends extending side by side into a handle, and the frame is of such cross section through out its length as to provide a continuous cavity accommodating a continuous core of synthetic plastic that is surface bonded to the metal frame either by means of a suitable adhesive or an operation such as polymerization in situ that will cause the particular plastic to strongly attach to the metal frame.

The essential feature of the invention is that, in the finished form racquet as in FIG. 1, the outer peripheral region of the head frame indicated at 14 be of a suitably large weight increase imparting cross section, and that the metal frame at both sides of the head be of successive decreasing cross section in a series of steps toward the handle. The net effect is to result in a racquet having a built-in weight distribution that provides desirable major weight at the outer part of the head, an effectively flexible throat, and an advanced balance point.

The metal frame member as shown in FIG. 1 preferably has the larger cross section region 14 extending symetrically with respect to the longitudinal axis L of the racquet for about 180°. At each end of region 14 the head cross section reduces along the sides of the head in successive regions indicated at 15, 16, 17 and 18. The junctures 19, 21, 22 and 23 between the successive regions appear externally as smooth shoulders. As the invention is applied to a more or less conventional type racquetball racquet wherein the generally oval head has a major axis of about twelve inches and a minor axis of about eight inches, the length of outer region 14 may be about sixteen inches and the incremental lengths of regions 15, 16 and 17 are about one and one-half inches. The wall thickness of region 15 is less than that of the head end region 14 and the wall thicknesses of regions 16–18 are progressively smaller with the wall thickness in the reversely curving throat area which includes section 18 being such that it may provide a certain amount of throat flexibility noticeable during play.

As compared to known metal or metal-plastic laminate frames the metal frame cross section in the outer end of the racquet of the invention is relatively heavier in the outer head region while being effectively but not uncontrollably flexible in the throat area. The balance point is thus advanced along the axis L toward the outer end of the head, thereby providing better control during swinging.

Figure 2:
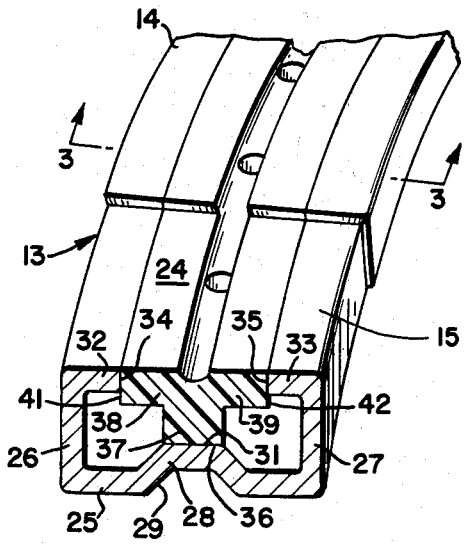
FIG. 2 is a fragmentary enlarged mainly sectional view substantially at line 2—2 of FIG. 1, illustrating the stepped construction of the frame in the racquet head.
Figure 3:
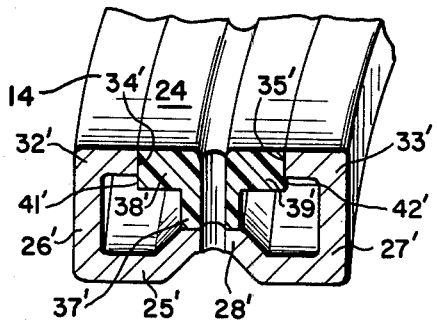
FIG. 3 is a section substantially at line 3—3 of FIG. 2 showing the larger metal cross section at the outer portion of the racquet head.

FIGS. 2 and 3 show a desirable cross section for the composite laminated frame. The metal frame member 13 is a generally U-shaped channel open outwardly of the racquet periphery, and the core is a continuous body 24 of solid synthetic plastic material fixed within the channel.

As shown the channel has a bottom wall 25 that defines the inner periphery of the striking head and side walls 26 and 27 that extend outwardly at right angles from the bottom wall. The bottom wall may have a longitudinally central outwardly projecting portion 28 that provides a recess 29 open inwardly along the inner head periphery and which may be said to impart a generally M-shape to the metal cross section. Portion 28 extends into the channel and provides a continuous narrow flat surface 31 adjacent the channel bottom. At the peripheral outer ends of the channel side walls, ribs 32 and 33 extend toward each other, terminating in opposed flat surfaces 34 and 35.

The body 24 of synthetic plastic may be a preformed extruded strip of generally T-shape in cross section having the flat bottom surface 36 of the stem 37 in flush contact with the channel surface 31. The laterally extending wings 38 and 39 of the T-shape are formed with flat surfaces 41 and 42 in abutment with metal rib surfaces 34 and 35.

Preferably, a suitable adhesive is interposed between the abuting surfaces 31, 36, 34, 41 and 35, 42 whereby the body 24 is permanently bonded within the channel. A longitudinal string receiving groove 43 is formed along the body 24 during extrusion, and string passage holes 44 are drilled into the head after the laminate is completed.

The above described cross sectional shape of the composite is generally the same as shown in Rodgers U.S. Pat. No. 4,066,260, except for the direction in which the metal channel opens. The invention in this embodiment is of such scope as to embrace both inwardly and outwardly open channel composites of this nature.

It will be noted that in the form of the invention shown in the drawings the metal channel walls and ribs of the outer head section 14 are thicker than those of the decreased size region 15 reason of the metal being built up on the outer surface of the channel. The same is true with respect to the relative channel wall thicknesses through the stepped regions 16–18. An advantage of this is that the same channel interior dimensions may be retained, notably the level of surface 31 and the distance between rib surfaces 34 and 35 whereby the plastic body 24 may be of constant lateral cross section along the entire frame. The invention however is of such scope as to embrace composite structures wherein the channel walls are thickened inwardly and/or where the plastic strip may also be correspondingly stepped to suit its location along the channel.

FIG. 3 shows the channel walls and ribs in the thicker frame section, indicated by numerals corresponding to FIG. 2 but being primes.

Similarly the invention embraces composite racquets having a double channel configuration wherein laterally outwardly opening channels, each containing a body of synthetic plastic bonded therein, are connected by a central web, such as disclosed in French Patents Nos. 2,321,911 and 2,336,962. Other examples of available metal frame member cross sections are disclosed in addition to said Rodgers patent, in Robinson U.S. Pat. No. 3,625,512; Vaughn et al. U.S. Pat. No. 3,702,701 and Australian Patent No. 238,250. Actually as will appear from the claims herein the invention may be applicable to substantially all metal and/or metal-plastic laminate racquets regardless of the cross sectional shape of the metal frame member.

The metal frame member may advantageously be of extruded aluminum or drawn steel. Exemplary of the mode of making the racquet is that indicated in FIG. 1 which shows a seam or joint S centered in the outer region of the head in alignment with the axis L. In fabricating the racquet each racquet frame half shown at opposite sides of the seam is formed as a straight stepped extrusion or drawn element which may be placed on a form and bent to substantially final shape, after which the two halves which are of the same size are joined effectively integrally as by welding at seam S to form the complete head outline. This seam is at least as strong as the metal on either side, and the racquet is usually so finished that it is invisible in the completed racquet.

The plastic body incorporated within the channel or other cavity of the metal frame member is usually an extrusion and may advantageously be of ABS or any equivalent plastic of suitable rigidity and high impact strength, notably nylon, rigid PVC or polycarbonate.

Where the plastic body is of preformed solid structure and inserted into the channel or other cavity of the metal frame member, the plastic body and the metal frame member are preferably bonded together substantially permanently, as by a suitable epoxy adhesive. Where the plastic body comprises thermoplastic or thermoformable material such as a polymerizable plastic in the form of an epoxy resin containing carbon or glass fibers the body is preferably placed in the channel or cavity in unpolymerized condition and polymerized in situ by the application of heat and pressure.

The opposite reduced size ends of the frame extend in side by side relation into a handle which may be of any conventional construction.

The invention in all aspects provides a game racquet that has an advantageously large part of its weight concentrated at the outer part of the head which contributes to the speed and power of the racquet while striking a ball. The built-in relatively flexible throat acts in combination with the increased weight outer head to provide a whip-like action that increases the power imparted to the ball being struck. The flexibility of the throat may be controlled by inserting a throat piece or yoke of suitable size extending between the portions 18 just before they are introduced into the handle. The overall effect is surprisingly somewhat like that attained in golf clubs having a shaft that tapers down toward a relatively heavy striking head. As compared to prior game racquets the racquet of the invention appears to provide for a better wrist break, which is particularly important in racquetball racquets.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A game racquet comprising a substantially integral metal frame member shaped longitudinally to define a striking head outline and terminate in side by side opposite end handle incorporated portions, characterized in that the frame member has a symmetrical outer head region remote from the handle that is of substantially uniform size in cross section and the opposite sides of said frame member extending from opposite ends of said outer head region each comprise a plurality of stepped similarly incremental regions successively decreasing in size in cross section toward the handle, said regions all being of the same general shape.

2. The game racquet defined in claim 1, wherein said frame member is a channel and a core member of solid plastic material is disposed within said channel.

3. The game racquet defined in claim 2, wherein said core member is bonded to internal surfaces of said channel.

4. The game racquet defined in claim 3, wherein said channel opens peripherally outward of the head.

5. The game racquet defined in claim 3, wherein said channel opens peripherally inward of the head.

6. The game racquet defined in claim 1, wherein the frame member defines a symmetrical arc about the outer head region wherein the metal walls of the member are of uniform thickness and thicker than in the remaining regions of the frame.

7. The game racquet defined in claim 1, wherein the stepped regions of the head are of progressively reduced wall thickness relative to the outer head region.

8. The game racquet defined in claim 1, wherein said frame member is shaped to exhibit a longitudinally extending recess or cavity that substantially retains its dimensions from end to end of the frame member, and a uniform thickness body or core of synthetic plastic is bonded within said recess or cavity.

* * * * *